US008650831B2

(12) United States Patent
Ehsani

(10) Patent No.: US 8,650,831 B2
(45) **Date of Patent: *Feb. 18, 2014**

(54) RECONSTRUCTION METHODS FOR STRUCTURAL ELEMENTS

(76) Inventor: Mohammad R. Ehsani, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/409,688

(22) Filed: Mar. 1, 2012

(65) Prior Publication Data

US 2013/0014467 A1 Jan. 17, 2013

Related U.S. Application Data

(60) Provisional application No. 61/572,245, filed on Jul. 14, 2011.

(51) Int. Cl.
*E04C 5/00* (2006.01)

(52) U.S. Cl.
USPC ..... 52/741.3; 52/742.1

(58) Field of Classification Search
USPC ..... 52/741.3, 742.14, 745.17, 834, 742.1; 405/216; 156/94; 118/404; 249/1
See application file for complete search history.

(56) References Cited

U.S. PATENT DOCUMENTS

| | | | | | |
|---|---|---|---|---|---|
| 1,947,413 | A * | 2/1934 | Hay | 249/1 |
| 2,412,185 | A * | 12/1946 | Weber | 405/216 |
| 4,068,483 | A * | 1/1978 | Papworth | 405/216 |
| 4,306,821 | A * | 12/1981 | Moore | 405/216 |
| 4,439,070 | A * | 3/1984 | Dimmick | 405/216 |
| 4,644,722 | A * | 2/1987 | Phillips | 52/514 |
| 4,699,703 | A * | 10/1987 | Norman | 204/196.3 |
| 4,892,601 | A * | 1/1990 | Norwood | 156/94 |
| 4,993,876 | A * | 2/1991 | Snow et al. | 405/216 |
| 5,591,265 | A * | 1/1997 | Tusch | 118/404 |
| 5,924,262 | A * | 7/1999 | Fawley | 52/834 |
| 6,364,575 | B1 * | 4/2002 | Bradley et al. | 405/216 |
| 6,536,991 | B1 * | 3/2003 | Trader et al. | 405/216 |
| 7,300,229 | B1 * | 11/2007 | Fyfe et al. | 405/216 |
| 2003/0085482 | A1 * | 5/2003 | Sincock et al. | 264/32 |

OTHER PUBLICATIONS

FRP Super Laminates Present Unparalleled solutions to Old Problems by Mo Ehsani, Reifnorced Plastics, Aug.-Sep. 2009.*
Saadatmanesh, et al, "Repair of Earthquake-Damaged RC Columns with FRP Wraps", ACI Structural Journal/Mar.-Apr. 1997, pp. 206-214.

(Continued)

*Primary Examiner* — William Gilbert
*Assistant Examiner* — Beth Stephan
(74) *Attorney, Agent, or Firm* — Arjomand Law Group, PLLC

(57) ABSTRACT

A method and an article of manufacture are disclosed for externally reinforcing various solid structures, such as columns, poles, piles, beams, pipes and the like, constructed from various materials. Multiple sheets laminated together with resin and grout constitutes a structure reinforcement wrap (SRW) for the formation of an external reinforcement shell. The multiple layers include a spacer sheet, a reinforcement sheet, such as Fiber Reinforced Polymer (FRP) saturated with resin. The spacer sheet creates a small, substantially planar space between the spacer sheet and the solid structure, which space may be filled with concrete, grout, epoxy, or other similar reinforcing material. In various embodiments, a surface groove is created in the solid structure and a reinforcing bar (rebar) is embedded in the groove to further structurally bond the solid structure to the reinforcing material poured in the planar space created by the spacer sheet.

14 Claims, 7 Drawing Sheets

(56) References Cited

OTHER PUBLICATIONS

Lopez-Anido, "Repair of Wood Piles Using Prefabricated Fiber-Reinforced Polymer Composite Shells", Journal of Performance of Constructed Facilities, ASCE, Feb. 2005, pp. 78-87.

"Pile Repair Sleeves for Challenging Substructure Repairs", Government Engineering ■ Jan.-Feb. 2006, pp. 30-31, (www.govengr.com).

* cited by examiner

Sec. E-E, External Column Shell

RECONSTRUCTION METHODS FOR STRUCTURAL ELEMENTS

CROSS-REFERENCE(S) TO RELATED APPLICATION(S)

This non-provisional application is related to U.S. provisional patent applications No. 61/572,245 filed on 14 Jul. 2011, the disclosure of which is hereby expressly incorporated by reference in its entirety, and the benefit of the priority date of which is hereby claimed under 35 U.S.C. §119(e).

TECHNICAL FIELD

This application relates generally to construction. More specifically, this application relates to a method and apparatus for externally reinforcing structures with a structure reinforcement wrap (hereinafter, "SRW").

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
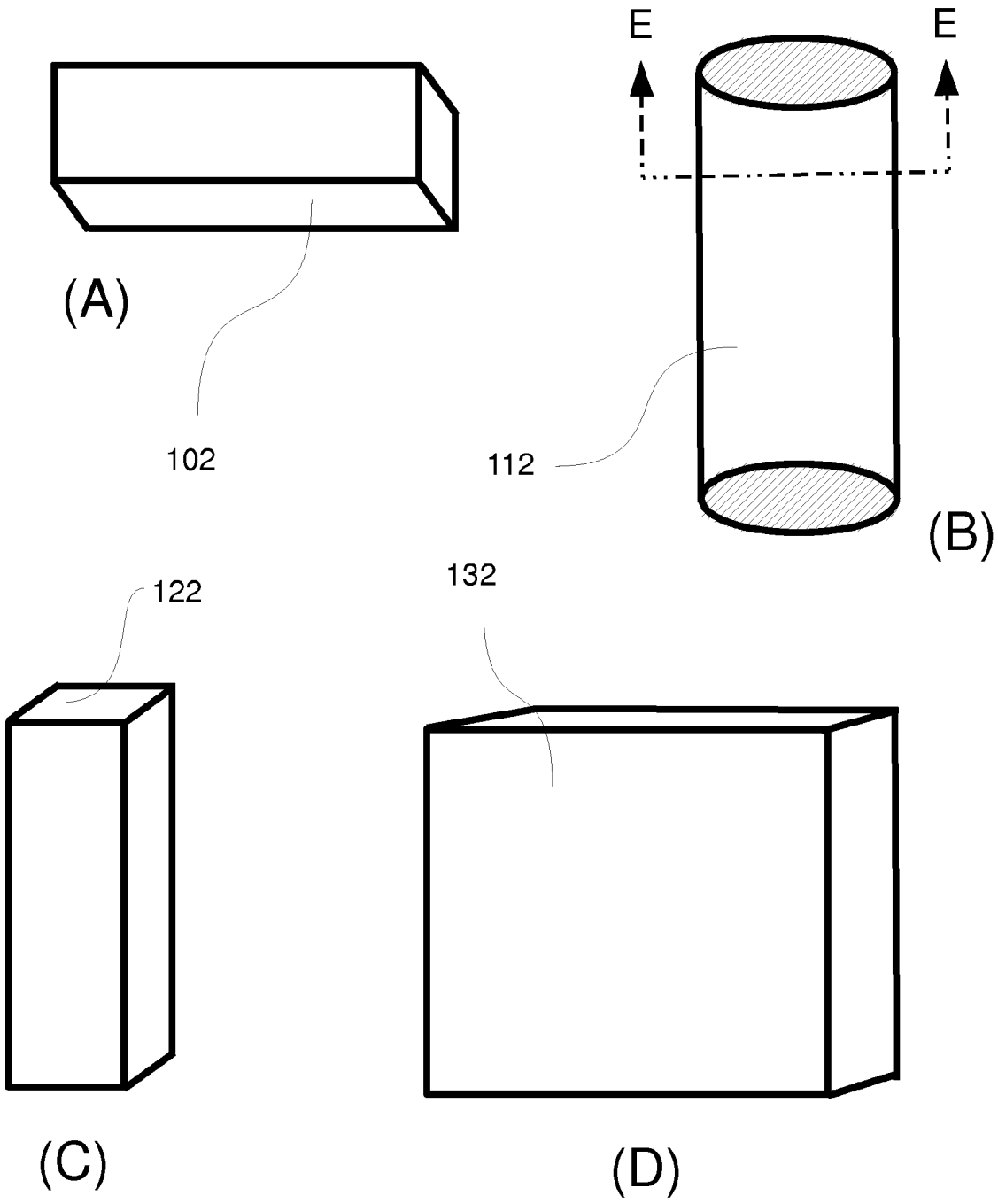
FIGS. 1A-1D show example structures suitable to be reinforced with reinforcement wrap.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references using a honeycomb laminate and/or spacer sheet layers surrounded by one or more layers of reinforcement material sheets to reinforce cylindrical structures, such as columns, it will be appreciated that the disclosure may include fewer or more laminate sheets to reinforce other types of structures, such as walls, chambers, beams, and the like.

Briefly described, a method and an article of manufacture are disclosed for externally reinforcing various solid structures, such as columns, poles, piles, beams, and the like, constructed from various materials including, but not limited to steel, concrete, masonry, wood, plastics, and the like. Some of the various structures may be used to support buildings, bridges, floors, utility and electrical power lines and the like; others can be hollow such as pipes or chimneys, etc. Multiple layers of various sheets may be wrapped around or otherwise attached to a surface of the structure to be reinforced to form an external shell. The multiple layers together constitute a structure reinforcement wrap (SRW) for the formation of the external shell, which may be partially formed by wrapping a spacer sheet around the solid structure, and wrapping one or more reinforcement layers, such as Fiber Reinforced Polymer (FRP) layers saturated with resin, around the spacer sheet. The spacer sheet creates a space between the spacer sheet and the solid structure, which space may be filled with concrete, grout, epoxy, or other similar reinforcing material. The SRW and concrete enclosed by the spacer sheet, thus form a solid shell around the solid structure, such as column or pipe, to reinforce the solid structure for bearing static and dynamic loads. Such loads include static weight, impact load, blast load, earthquakes, moving vehicle loads, wind load, fluid pressure and the like. In various embodiments, a groove is created in the solid structure and a reinforcing bar (rebar) is embedded in the groove to further structurally bond the solid structure to the concrete poured in the planar space created by the spacer sheet. In other embodiments reinforcing bar (rebar) is merely placed in the space created by the spacer sheet before filling the space with concrete, grout, epoxy, or other similar reinforcing material.

Structural repair can be expensive, cumbersome, and time consuming. Structures can get damaged due to a variety of factors, such as earthquakes, overloading, weight of traffic, wear and tear, corrosion, explosions, and the like. Prevention is generally more cost-effective than repairs. As such, it is generally easier and more cost-effective to strengthen a structure that may be exposed to damaging forces and loads, than waiting to repair such eventual damages after they occur or to replace the structure with a new one. Intentional damage inflicted upon infrastructure, by terrorism or vandalism, is another way that structural damage may result. For example, recently, there has been growing interest to strengthen the above-mentioned structures for blast loading, such as terrorist attacks, which may seek to blow up a building, a bridge, a pipe and the like, by placing a bomb adjacent to the structure and detonating it. In addition to prevention, if damage does occur to a structure, a cost-effective and speedy method of repair is clearly desirable.

One of the problems with existing structural support components such as columns, piles, poles, and pipes is that they are subject to corrosion that weakens these structures. Since these support structures may be submerged in water or be buried in soil, it is more cost-effective and thus preferred to repair them without using expensive diving gear and complex underwater procedure or digging them out of the ground. Often, these support components are subjected to traffic, wind, and weight loads. Thus a repair material and method should not only provide protection against corrosion, but also provide additional strength for the support component.

FIGS. 1A-1D show example structures suitable to be reinforced with reinforcement wrap. FIG. 1A shows a beam 102 in a horizontal position, while FIG. 1B shows cylindrical structure 112, such as a column, a pole, a pile, a chimney, and the like; however, these structures may not be cylindrical. A section E-E of FIG. 1B is shown in greater detail in FIGS. 2A and 2B. FIGS. 1C and 1D show structures 122 and 132 with rectangular cross-sections, such as walls and square or rectangular columns. FIG. 2B shows a hollow structure 242 that can have a cylindrical or oval shape cross section, such as a pipe. Any of these structures may be reinforced by external shells constructed using SRW. Structures of relatively smaller sizes and accessible configurations, such as columns, may be wrapped with SRW laminate, while relatively larger and/or inaccessible structures such as walls, entire buildings, and the like may be augmented with external shells made from SRW laminates on their surfaces, which may be exposed to potentially damaging loading, such as external wall surfaces. Those skilled in the art will appreciate that the structure to be reinforced may have any cross sectional shape in addition to round and rectangular, such as triangular, oval, polygonal, irregular, and the like.

Figure 2A:
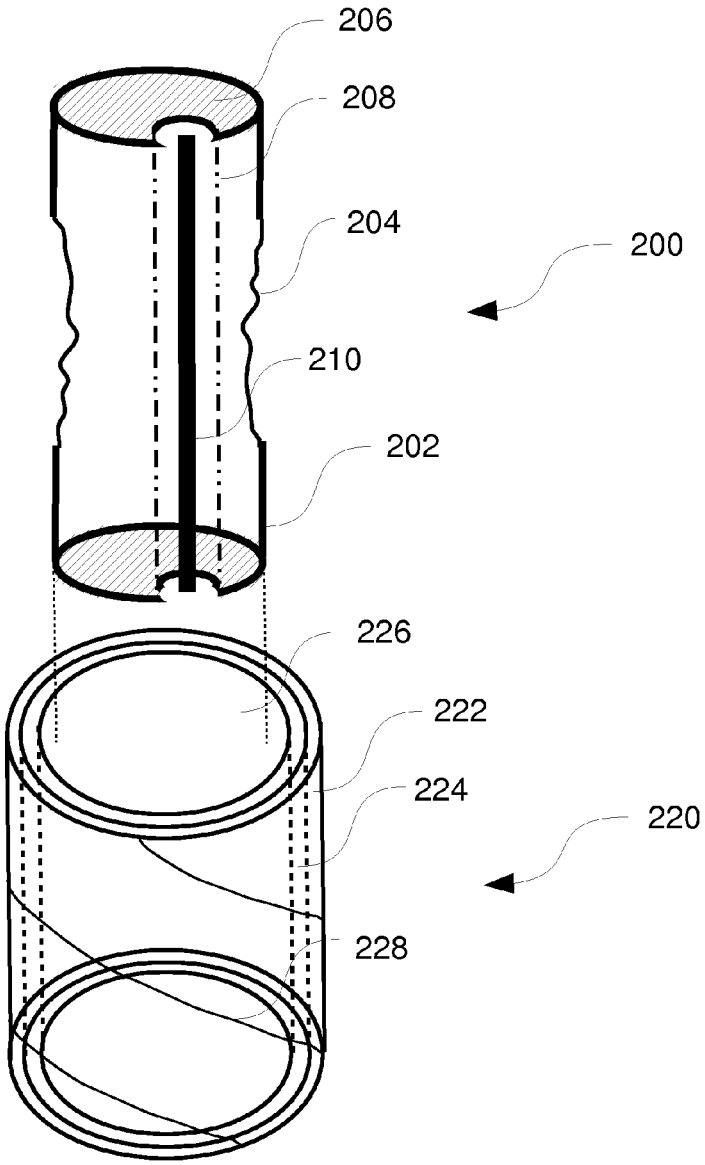
FIG. 2A shows an example deteriorated column reinforcement using a shell made from structure reinforcement wrap (SRW) and added rebar.
Figure 2B:
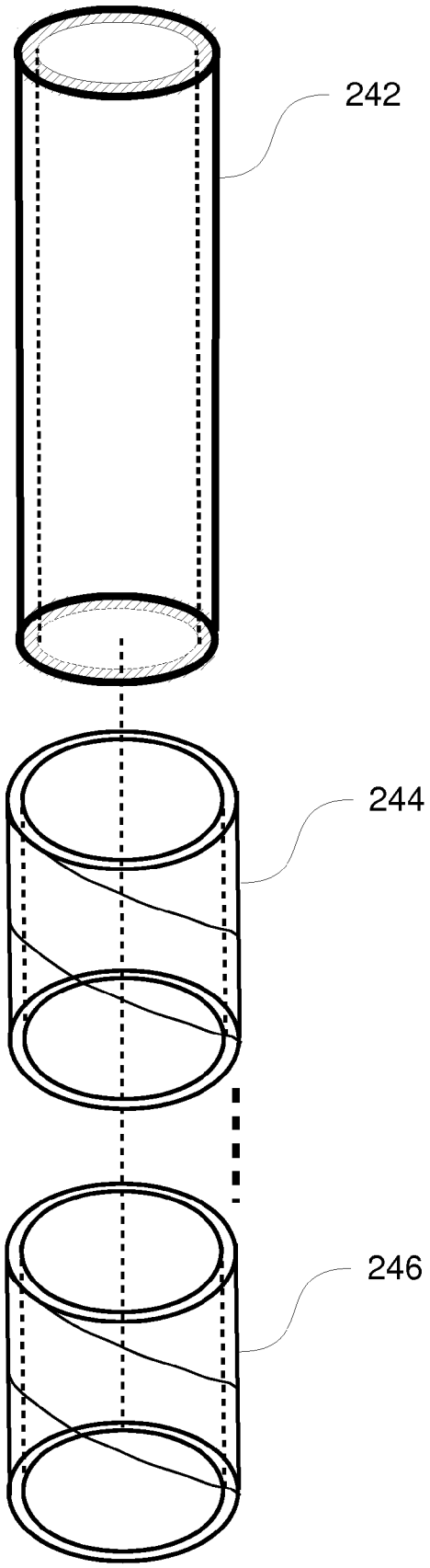
FIG. 2B shows an example column reinforcement using multiple shell segments made from SRW.

FIG. 2A shows an example deteriorated column reinforcement using a shell made from structure reinforcement wrap (SRW) and added rebar. In various embodiments, reinforcement arrangement 200 includes a structure, such as column 202, having a deteriorated section 204 and an interior 206. For additional reinforcement and/or repair, groove 208 is created near the surface of column 202 and rebar 210 is deployed within groove 208. External reinforcement shell 220 includes an outer reinforcement layer 222, an inner spacer layer 224, a hollow interior 226, and spiral seams 228 formed by spirally wrapping layers 222 and 224 to form the shell. The reinforcement wrapping may be cylindrical instead of or in addition to the spiral.

In various embodiments, external reinforcement shell 220 is constructed in the field in place around the structure to be reinforced, such as a column. The construction of the shell includes wrapping a sheet of spacer, typically about 1-3 feet wide, around the column. The spacer sheet may be held in a wrapped position using a string, staples, tape, and the like, to prevent it from bouncing back due to its stiffness. Next, a reinforcement sheet, such as an FRP fabric saturated with resin may be wrapped once or more around the spacer sheet. For shells longer or taller than the width of the spacer sheets, the sheets are wrapped around the column in a butt-jointed fashion and the FRP sheets are wrapped in an overlapping spiral fashion to extend the length of the shell beyond the width of such sheets. The overlap of the spiral wrapping FRP sheets seals the shell and add to its strength. Next, fill the space created between the spacer sheet and the column with a reinforcing material such as resin, grout, concrete, polymer modified concrete, and the like. In some embodiments, the wrapping of the FRP sheets may not be a spiral wrapping at an angle, but a complete overlap of the reinforcement sheet at 0 degree angle.

In various embodiments, the reinforcement sheet, such as FRP fabric, may be pre-saturated with resin and activated in the field after wrapping around the spacer sheet to create a stiff shell. The resin may be activated to harden by various methods such as by using Ultra Violet (UV) light, exposure to air, exposure to water by spraying water on it, exposure to another chemical, and the like.

In various embodiments, prior to forming external reinforcement shell 220 around the column, surface grooves 208 may be cut along the height of the column or wooden pile and reinforcing steel bars (rebars) may be inserted in those grooves. In such embodiments, when the space between the spacer layer and the column is filled with reinforcement material such as grout or resin, the rebars are covered with the material and further help bond the shell to the column and further strengthen the column against both axial and bending stresses.

FIG. 2B shows an example column reinforcement using multiple shell segments made from SRW. In various embodiments, a solid structure, such as column or a hollow structure such as a pipe 242, is reinforced using multiple external reinforcement shell segments 244, 246, each shell segment constructed in a manner similar to that described above with respect to FIG. 2A.

Concrete, steel & timber columns, utility poles, and underwater piles, other similar support structures often need to be repaired or strengthened due to deterioration over time or damage caused by events such as floods, earthquakes, and accidents. Generally, the repair necessitates the worker to be at a working position adjacent to and at the same elevation or point as the damaged area of the column or pile. To provide such proximity to damaged area, it is necessary to have access to the damaged area. When the damaged area of the pole or column is below ground or under water, such access substantially increases the repair cost due to the need for special equipment and skills and also due to the working conditions and procedures.

To repair and/or to reinforce such damage areas without direct access, in some embodiments, a number of sufficiently stiff or rigid shells which can hold their shape and can be moved away from the working position, up or down, along a column (or left and right along a pipe) may be employed. The space between such a shell and the damaged or host column may be filled with a reinforcing material to bond the shell to the host column and make the column and the shell work together against loading stresses.

FRP in the fabric form is flexible prior to curing, and thus it cannot hold its shape or be pushed up or down along the height of the column. Each of the multiple shell segments 244 and 246 may be constructed as described above with respect to FIG. 2A. Such shells may be a few feet tall and sufficiently stiff to be pushed up or down the column while maintaining its shape. As each shell is constructed, an extra strip of spacer sheet is provided at each end of the shell segment for joining the segments together to form a taller or longer shell segment. Next, another sheet of spacer is butt-jointed to the top of the spacer sheet of the previous shell segment to start the construction of the next shell segment. The FRP resin-saturated fabric is wrapped around the new spacer sheet, eventually resulting in a longer shell made from the combination of the current shell and the previous shells. This extended shell may now be lowered to an elevation below (or above) the workers constructing the shell segments. For example, if the workers are working on a barge to repair a pile in water, the finished portion of the shell can be pushed down under the water surface without requiring divers or underwater equipment. The above procedures may be repeated until a sufficiently tall shell has been created to enclose the desired (or damaged) portion of the pile.

For under water applications, the bottom of the space between the first shell and the pile is sealed to prevent water from seeping in and corroding or causing further damage to the pile's base. Sealing may be done in various ways, such as by using an inflated bladder like a bicycle tube or Oakum rope, or by having a built-in edge or lip at the bottom of the first sheet. Next, the space between the shell and the pile is filled with a reinforcing material such as resin, grout, concrete, polymer, modified concrete, or special underwater grouts, a resin that has been mixed with sand or other filler materials to reduce the unit cost per volume. The reinforcing material bonds the external shell to the host column or pile and prevents moisture and oxygen to enter into the enclosed area and corrode the reinforcing bars or decay the concrete.

The outer surface of the pile jacket or external shell may be painted to protect it from environment and/or to provide a more aesthetic appearance. Such painting may also be performed in a step by step manner on each piece of the finished shell segment above waterline before it is pushed down into water.

In various embodiments, the spacer sheet has integrated protruding "T" profiles (having a "T" shaped cross section), to create a predetermined distance between the spacer sheet and the host column, as further described below with respect to FIGS. 3 and 4. If the T profiles are continuous along the length of the spacer sheet, they can act as walls along the height of the column, dividing the space into several separate long vertical cells. This may not be desirable as it will not allow the grout or resin to flow over the entire space and each cell has to be filled separately—a time consuming process. In some embodiments, these protruding profiles on the spacer sheet are not a one-piece continuous element, rather, each profile is discontinuous along the spacer sheet, forming separate profile segments each a few inches long. This configuration allows enough space between profile segments to allow flow of grout and resin to fill the entire space in one operation.

In some embodiments, the spacer sheet may be specially designed with protruding T-shapes or other shapes that in addition to helping define the width of the space, they may bond to and get locked in the reinforcing grout or resin and improve the coupling between the outside shell and the host column or pile.

The procedure described above may be used for the repair of utility poles or bridge piers below grade and extending to regions above grade. Once the shell is created above ground as described earlier, the stiff shell may be lowered below grade. To do this, a small space may be cut around the pole in soil using various methods such as using a high pressure water jet (such as commercially available pressure washers with a longer nozzle attached) or high pressure air. Once the space is created, the stiff shell is lowered into ground to its final position. The earth at the base can be used to create a seal at the bottom of the shell. Then the space is filled with resin or grout or any combination described above.

In various embodiments, the spacer sheet includes support components, such as clips, for holding rebar in place in a desired position and orientation within the space while filling the space with resin or grout. For example, the clips may hold the rebars vertically and in the correct distance relative to the host column while the grout is poured in the space.

In some embodiment, the upper and lower edges of the spacer sheets may include male/female type connectors or fasteners, which allow them to be securely coupled and locked together to create a substantially sealed joint to prevent the grout or resin from escaping from these joints. Similarly, the vertical edges of each Spacer sheet may be connected together to create a leak-proof seam. An "H" shaped plastic channel (a small channel with H-shaped cross section) may be slipped over spacer sheet edges to create a secure joint for pouring reinforcing material in the space during construction.

Figure 3A:
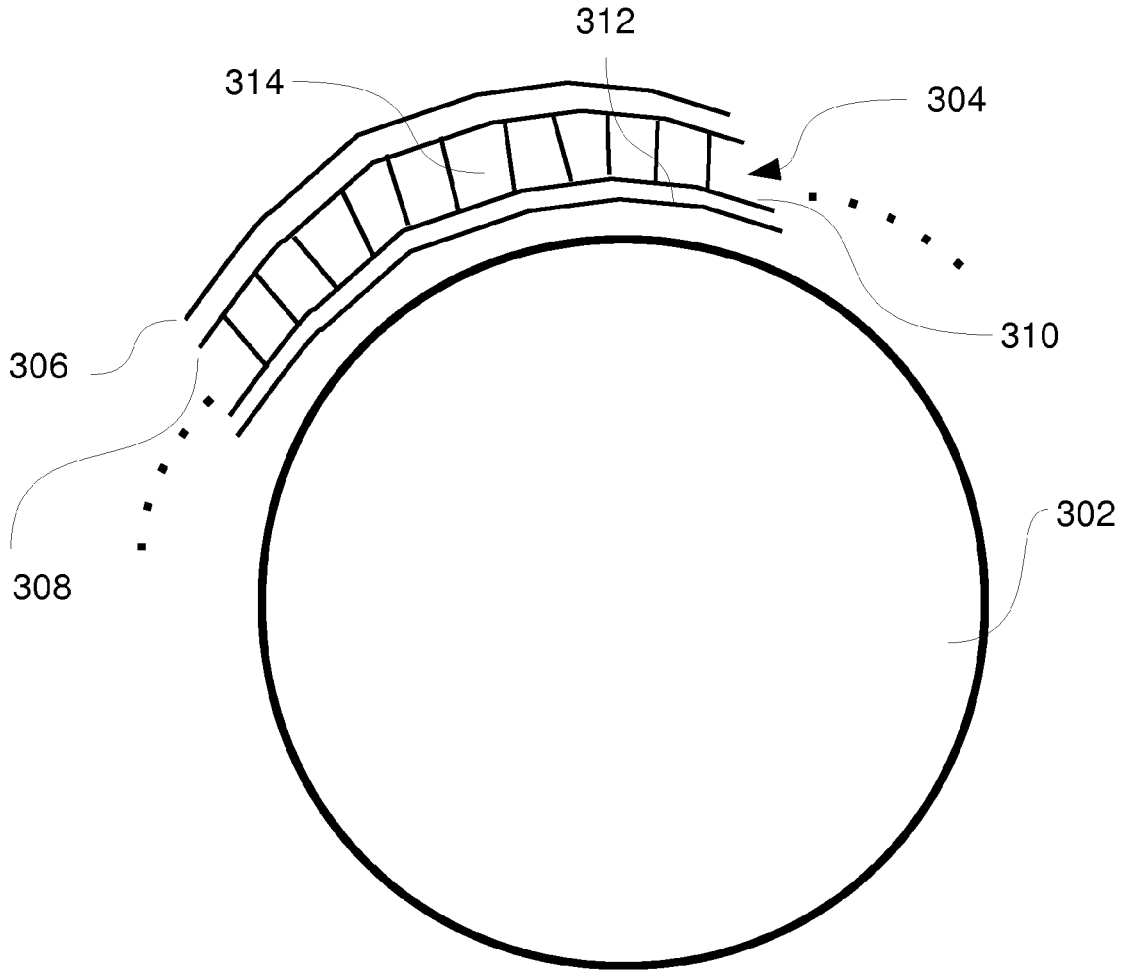
FIG. 3A shows an example cross section of a column reinforcement shell using SRW with a honeycomb layer.
Figure 4:
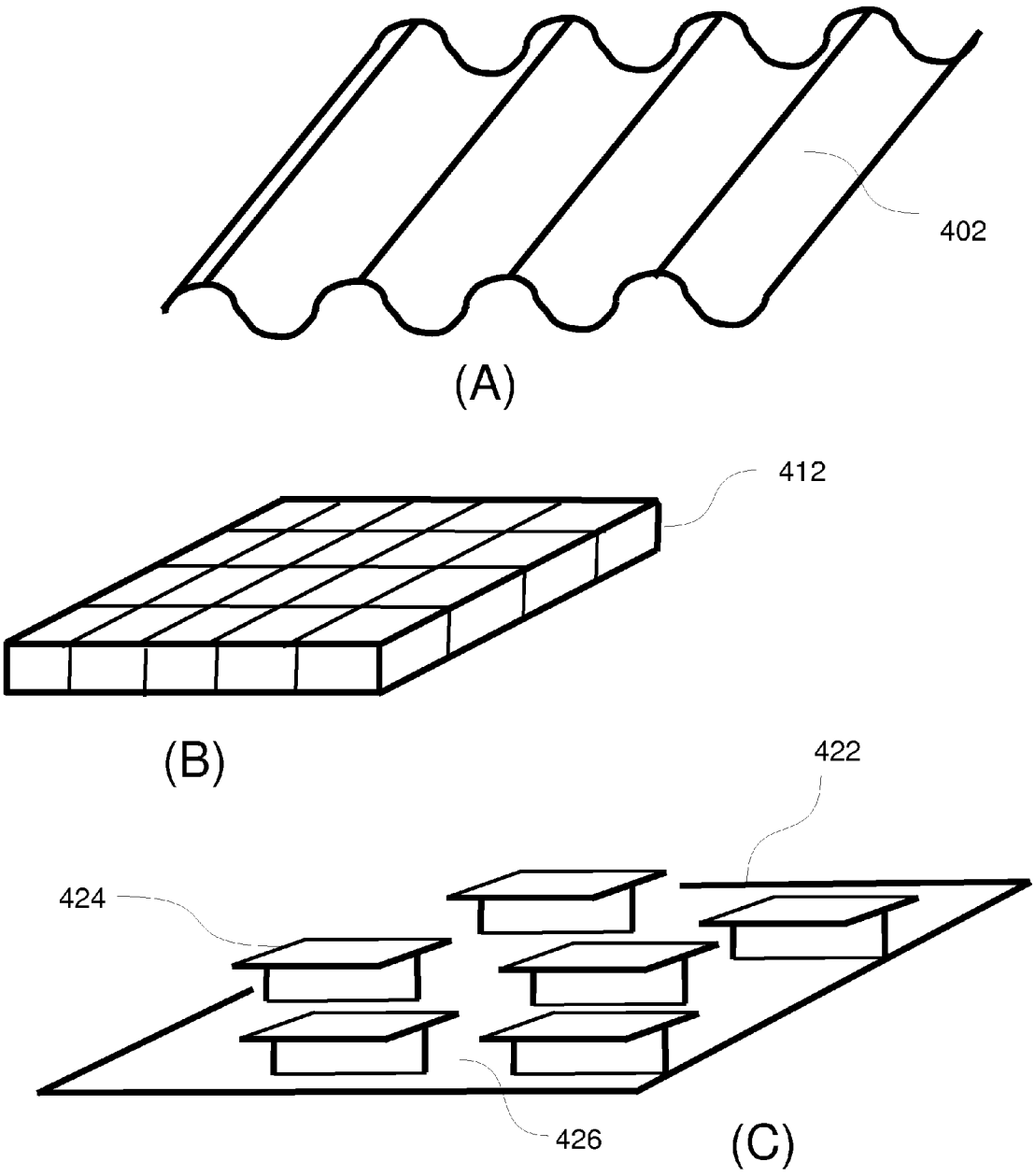
FIGS. 4A-4C show example corrugation, honeycomb, and partial-channel spacer layers usable as SRW layers.

FIG. 3A shows an example cross section of a column reinforcement shell using SRW with a honeycomb layer. Cross-section of the section E-E of FIG. 1B is depicted in FIG. 3A. In various embodiments, structure 302 is wrapped, covered, or augmented with SRW laminate constructed from and including reinforcement layers 306, 308, 310, 312, and honeycomb layer 314 to form a stiff shell 304 around the column. Honeycomb layer 314 may be laminated with at least two skin layers, for example, layers 308 and 310 to form a honeycomb or largely hollow laminate.

In various embodiments, structure 302, which may be a column, a pole, a pile, a pipe, a wall, or other similar structure, is reinforced by multiple layers of reinforcement sheets including honeycomb or hollow-structure layer 314. Honeycomb layers are generally constructed of adjacent cells, each cell having walls that enclose the cells. Within each of the cells and surrounded by the cell walls, a hollow space is created to reduce the weight of the honeycomb or hollow-structure layer. The cell walls create a relatively thick sheet, the thickness of the sheet being substantially determined by the height of the cell walls, which sheet has substantially greater stiffness compared to a flat sheet of the same sheet material without such cells and cell walls.

In various embodiments, the reinforcement sheet is constructed from fiber-reinforced material, such as Fiber Reinforced Polymer (FRP) to give the sheets more resistance against various types of loading, such as blast loading. Those skilled in the art will appreciate that many types of reinforcement fibers may be used for reinforcement including polymer, fiberglass, metal, cotton, other natural fibers, and the like. The sheet materials may include fabrics made with fibers such as glass, carbon, Kevlar, Nomex, aluminum, and the like, some saturated with a polymer such as polyester, vinyl ester, or epoxy for added strength, wear resistance, and resilience. The fibers within a reinforcement sheet may be aligned in one direction, in cross directions, randomly oriented, or in curved sections to provide various mechanical properties, such as tearing tendency and differential tensile strength along different directions, among others.

The reinforcement layers may be laminated in the field using epoxy, various glues, or similar adhesives to create a thick laminate that will be stiffer than the sum of the individual reinforcement layers 306, 308, 310, 312 placed around structure 302. Different reinforcement layers may use sheets with fibers oriented in different directions, such as orthogonal directions, with respect to other sheets to further reinforce the SRW.

With continued reference to FIG. 3A, reinforcement sheets 306-314 are available from industrial sources and range in thickness from about 0.020 inches to a few inches depending on application. Those skilled in the art will appreciate that thinner or thicker sheets may be constructed and used as needed. Honeycomb or hollow structure itself is available in various geometrical cell shapes, as further described with respect to FIG. 4 below, and it provides cells that when sandwiched between a first and a second honeycomb skin layers made from thin reinforcement sheets results in a light-weight but stiff laminate sheet, like the honeycomb laminate, with many applications, such as in the construction of the floor of commercial aircraft, fuselage of fighter planes, and watercraft. This honeycomb laminate layer structure provides additional strength to SRW and may serve as a structure to dissipate impact and blast energy, resulting in less damage to the reinforced structure 302. SRW may be wrapped continuously or in sections around the entire outside surface of structure 302 like a wide tape to create a closed, overlapping multi-layered shell enclosing structure 302.

In various embodiments, multiple honeycomb laminates may be employed to further reinforce SRW. Various layers in the SRW may be glued to each other to form one integral laminate wrap. In some embodiments, each layer in the SRW may be made from a different or same type of reinforcement sheet to develop different costs, performances, and mechanical properties for the SRW. For example, the outer layers may be made from thicker and tougher reinforcement sheets while the inner layers (closer to the structure) may be made from thinner and more flexible sheets to save material and installation or construction costs. Other variations in sheet layers are possible, such as fiber types and orientations, sheet materials, sheet material properties like chemical resistance, heat resistance, gas and fluid impermeability, and the like. SRWs made with such variations in reinforcement layers will exhibit different mechanical and chemical properties suitable for different applications, costs levels, and considerations such as environmental and public safety considerations.

The multi-layer embodiments may be pre-glued and integrated prior to application to a structure or be integrated during the application to the structure.

In other various embodiments, some or all of the honeycomb or hollow-structure cells may be filled with one or more of a filler material, such as foam, concrete, polymer, and the like to displace the air within the cells and provide additional strength to the honeycomb or hollow-structure layer. The cell filling material may be injected or otherwise be placed within the cells after attaching the first honeycomb or hollow-structure skin layer, and then be covered and glued in place with the second skin layer. The skin layers themselves may be multi-layered in some embodiments.

In application, in various embodiments, the reinforcement layers are applied to the surface of the structure to be reinforced, one layer at a time using appropriate adhesives. Most honeycomb laminates are fairly stiff and cannot be wrapped around a structure as an integral prefabricated laminated layer. To facilitate the wrapping or attachment of the honeycomb layer to the structure, the honeycomb layer may be bonded to a first skin 310 in a manufacturing plant and after this assembly step, the honeycomb laminate is wrapped around the structure, and then second skin 306 is bonded to the open or free face of the honeycomb layer to complete the honeycomb laminate. Additional honeycomb layers or additional reinforcement layers may be applied to structure 302 to provide further strength for the structure. Alternatively, at least a first layer of thin laminate may be wrapped around or applied to the structure, then a layer of honeycomb may be glued or otherwise attached to the first layer of thin laminate, and finally at least a second layer of thin laminate sheet may be glued to the open face of the honeycomb. This process effectively constitutes the building of the honeycomb laminate in the field around the structure.

Figure 3B:
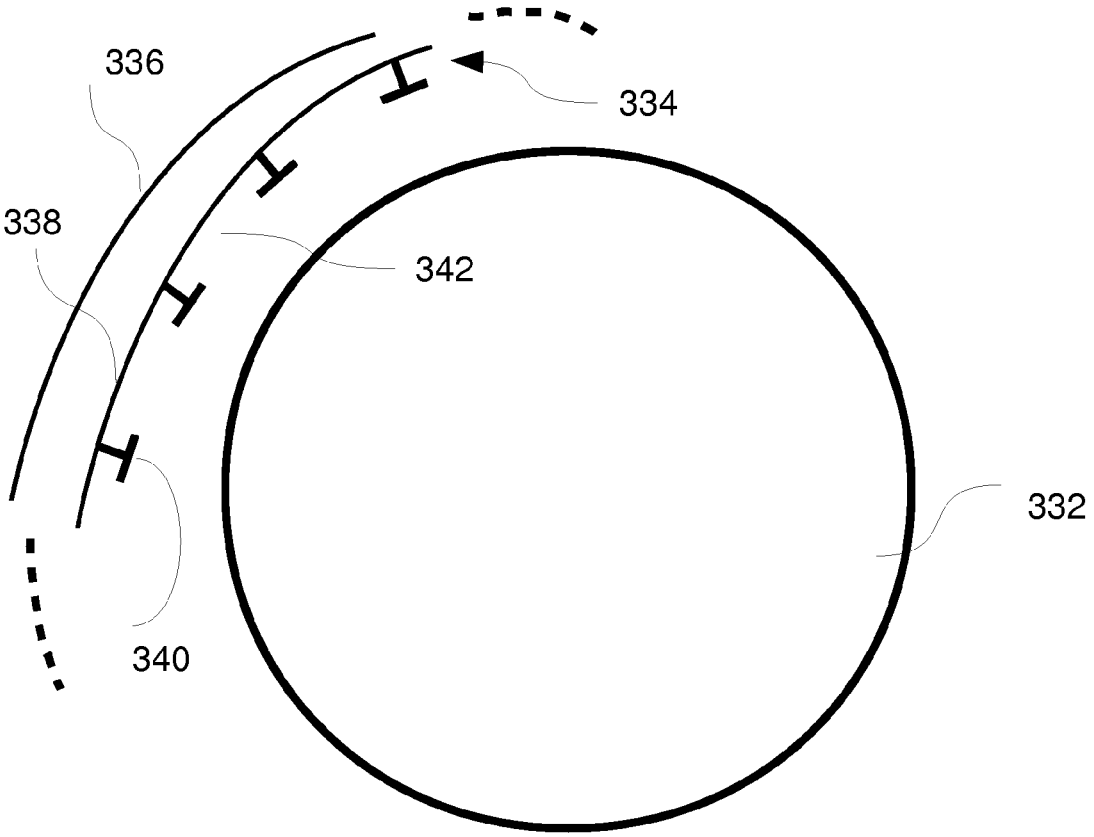
FIG. 3B shows an example cross section of a column reinforcement using SRW with a spacer layer.

FIG. 3B shows an example cross section of a column reinforcement using SRW with a spacer layer. In various embodiments, solid structure 332 is reinforced with an external reinforcement shell 334 including spacer sheet 338 having protrusions 340 to create space 342, and reinforcement sheet 336.

In various embodiments, an external reinforcement shell 334 is constructed around solid structure 332, for example, a column, substantially as described above with respect to FIG. 2A. Spacer sheet 338 is first wrapped around structure 332. Protrusions 340 create space 342 with a predetermined width between spacer sheet 338 and structure 332. Reinforcement sheet 336, for example, a resin-saturated FRP sheet, is wrapped around the spacer sheet to create a shell. Next, a reinforcement material, such as grout or resin is poured into space 342 to fill the space and create a solid bond between the shell and the column. In various embodiments, rebars may be deployed inside the space or in grooves cut on the surface of the column to bond with the resin or grout in the space and further reinforce the column.

In various embodiments, the spacer sheet T-profiled protrusions 340 may be used to further reinforce and stiffen shell 334. The protrusions are generally in the form of elongated beams or walls (T-shape cross section shown in FIG. 4C), having "T-shaped", "I-shaped", or other desirable cross sectional shapes, which may be oriented along the length of the pipe, in hoop direction, diagonally around the pipe, or in a random fashion. In various embodiments, T-profiled protrusions may be used in wet resin or grout, in a manner similar to rebars, to more effectively bond and integrate the shell with the column, to further reinforce and stiffen the column.

In some embodiments all or some of the different layers mentioned throughout this disclosure may have been manufactured as a single multi-functional layer. For example in FIG. 3B, layers 334, 336, and 338 may all be manufactured as a single layer and be applied to structure 332 as a single layer.

FIGS. 4A-4C show example corrugation, honeycomb, and partial-channel spacer layers usable as SRW layers. Commercially available perforated plastic sheets may also be used for the same purpose. FIG. 4A shows an example corrugated structure 402 that in some embodiments may be used instead of the cell-based honeycomb layer described previously. The manufacturing and availability of such corrugated structures 402 may provide a cost advantage in some applications.

FIG. 4B shows an example square-celled honeycomb structure 412, where each cell is in the form of a square or rectangle rather than a hexagon or octagon as is typically implied by the term "honeycomb". Honeycomb structure may be constructed from many different materials similar to those listed and described above with respect to the reinforcement sheets, such as aluminum, PVC, Kevlar, Nomex, and the like.

FIG. 4C shows an example spacer sheet 422 with discontinuous T-profiled protrusions 424 having discontinuities 426, which create partially open channels between the protrusions to allow flow of reinforcing material such as grout or resin between the protrusions to completely fill the space created between the spacer sheet and the host column from one inlet point. Those skilled in the art will appreciate that other discontinuous protrusions on a spacer sheet are possible without departing from the spirit of the present disclosures. For example, protrusions may be in the form of randomly distributed and oriented wall segments, maze, concentric discontinuous circles, and the like.

Those skilled in the art will appreciate that many other honeycomb type layers, hollow structures, or laminate structures are possible without departing from the spirit of the present disclosures. For example, the honeycomb cells may be constructed in any geometric form, such as rectangle, hexagon, and the like to serve the same purpose.

Figure 5:
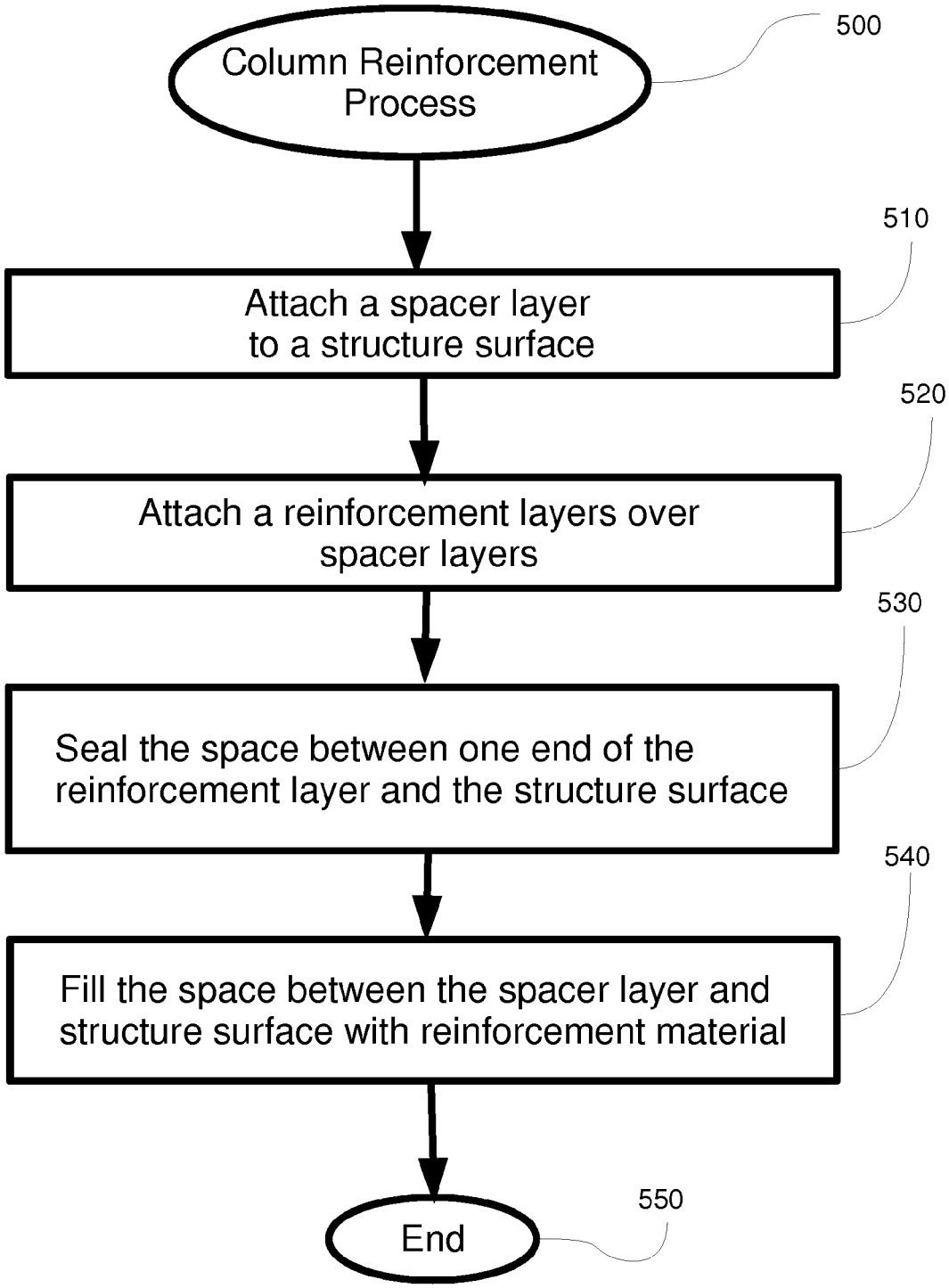
FIG. 5 shows an example process of reinforcing a column using SRW having a spacer layer.

FIG. 5 shows an example process of reinforcing a column using SRW having a spacer layer. Process 500 proceeds to block 510 where a spacer layer is wrapped around a structure to be reinforced, such as a host column, pile or pipe. As described above with respect to FIGS. 2A and 4C, different types of spacer sheets may be used as the spacer layer in constructing the SRW and the reinforcement shell. Such sheets may be held in place around the host column using tape, locking components, and the like. The spacer layer may be wrapped in a non-overlapping spiral fashion or just as a ring to form a desired length for the reinforcement shell. The process proceeds to block 520.

At block 520, one or more reinforcement layers, such as an FRP fabric, are saturated with resin and wrapped tightly over the spacer sheet to stay in place by adhesion. The reinforcement layer may be wrapped in an overlapping spiral fashion or as overlapping rings to form a desired length for the reinforcement shell. The reinforcement layer may be pre-saturated with resin and be activated on site during application by various methods, such as natural or artificial UV light. The process proceeds to block 530.

At block 530, one end of the space between the spacer layer and the host column is sealed.

At block 540, the space created between the spacer layer and the host column is filled with a reinforcing material such as resin, concrete, grout, and the like. The process proceeds to block 550.

At block 550, the process terminates.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A method of constructing a rigid shell for reinforcement of structures, the method comprising:

providing a spacer sheet, bending and wrapping the spacer sheet around a structure creating a space between the spacer sheet and the structure;

wrapping, one or more times overlappingly, a reinforcement sheet around the spacer sheet, the spacer sheet and reinforcing sheet creating a rigid reinforcement shell; and filling the space with a reinforcing material.

2. The method of claim 1, further comprising saturating the reinforcement sheet with resin.

3. The method of claim 1, further comprising creating a groove in the structure and deploying a rebar within the groove, or deploying a rebar within the space, or both.

4. The method of claim 1, wherein the reinforcement sheet is pre-saturated with resin configured to be activated to cure with Ultra Violet (UV) light or water, or wherein the reinforcement sheet is a Fiber Reinforced Polymer (FRP).

5. The method of claim 1, wherein the spacer sheet protrusions have one of a T-shaped and an I-shaped profile configured to created a predetermined width for the space.

6. The method of claim 1, wherein the spacer sheet is perforated.

7. The method of claim 1, wherein the space between one end of the rigid reinforcement shell and the structure is sealed to prevent reinforcing material from escaping the space between the rigid reinforcement shell and the structure.

8. The method of claim 1, wherein the structure is at least partially submerged in water or is at least partially underground.

9. A method of reinforcing a structure, the method comprising:

providing the structure with a working position and a reinforcing position spaced from the working position, creating a plurality of rigid reinforcement shell segments around the structure at the working position, wherein creating each of the reinforcement shell segments comprises bending and wrapping the spacer sheet around the structure creating a space between the spacer sheet and the structure and wrapping a reinforcement sheet around the spacer sheet;

moving each of the reinforcement shell segments along the structure away from the working position to the reinforcing position; coupling the reinforcement shell segments together to create a single rigid reinforcement shell around the structure; and after moving the shell segments, filling the space between the single reinforcement shell and the structure with a reinforcing material.

10. The method of claim 9, wherein the reinforcement sheet is wrapped overlappingly around the spacer sheet.

11. The method of claim 9, wherein the spacer sheet includes protrusions configured to create a predetermined width for the space.

12. The method of claim 11, wherein the protrusions have one of a T-shaped and an I-shaped profile.

13. The method of claim 9, wherein the spacer sheet is perforated.

14. The method of claim 9, wherein the space between one end of the single reinforcement shell and the structure is sealed to prevent reinforcing material from escaping the space between the single reinforcement shell and the structure.

* * * * *